US010687610B2

(12) United States Patent
Jimenez et al.

(10) Patent No.: US 10,687,610 B2
(45) Date of Patent: Jun. 23, 2020

(54) ORAL CARE IMPLEMENT

(71) Applicant: Colgate-Palmolive Company, New York, NY (US)

(72) Inventors: Eduardo Jimenez, Manalapan, NJ (US); Robert Moskovich, East Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/539,342

(22) PCT Filed: Dec. 23, 2014

(86) PCT No.: PCT/US2014/072036
§ 371 (c)(1),
(2) Date: Jun. 23, 2017

(87) PCT Pub. No.: WO2016/105356
PCT Pub. Date: Jun. 30, 2016

(65) Prior Publication Data
US 2017/0354240 A1 Dec. 14, 2017

(51) Int. Cl.
*A46B 9/02* (2006.01)
*A46B 9/04* (2006.01)

(52) U.S. Cl.
CPC ..... *A46B 9/025* (2013.01); *A46B 9/04* (2013.01); *A46B 9/028* (2013.01); *A46B 2200/1066* (2013.01)

(58) Field of Classification Search
CPC ..... A61C 17/222; A46B 9/04; A46B 9/028; A46B 9/026; A46B 9/025
See application file for complete search history.

(56) References Cited

U.S. PATENT DOCUMENTS 758,764 A 5/1904 MacLeod
846,900 A 3/1907 Bloom
(Continued)

FOREIGN PATENT DOCUMENTS

AR 71556 10/2003
AR 80042 11/2009
(Continued)

OTHER PUBLICATIONS

International Search Report and the Written Opinion issued in International Application PCT/US2010/046806 dated Mar. 16, 2011.
(Continued)

*Primary Examiner* — Laura C Guidotti

(57) ABSTRACT

An oral care implement that includes a conical tuft of bristles. In one embodiment, the invention is an oral care implement that includes a handle and a head coupled to the handle, the head having a front surface. A plurality of tooth cleaning elements extend from the front surface of the head. The plurality of tooth cleaning elements include a conical tuft that has a continuous bristle wall having an inner surface defining a cavity, the cavity having a transverse cross-sectional area that increases with distance from the front surface of the head. The plurality of tooth cleaning elements may also include a central cleaning element located within the cavity. The conical tuft may terminate in an annular top surface that undulates in height relative to the head. The plurality of tooth cleaning elements may include arcuate cleaning elements arranged in a loop about the conical tuft.

19 Claims, 10 Drawing Sheets

(56) References Cited

U.S. PATENT DOCUMENTS 1,125,532 A 1/1915 Himmel
1,901,230 A 3/1933 Palmer
1,924,152 A 8/1933 Coney et al.
2,161,349 A 6/1939 Hadden
2,186,005 A 1/1940 Casto
2,305,461 A 12/1942 Spyra
D273,635 S 5/1984 Stocchi
4,517,701 A 5/1985 Stanford, Jr.
4,958,402 A 9/1990 Weihrauch
5,144,712 A 9/1992 Hansel et al.
5,339,482 A 8/1994 Desimone et al.
5,392,483 A 2/1995 Heinzelman et al.
5,584,690 A 12/1996 Maassarani
5,604,951 A 2/1997 Shipp
5,628,082 A 5/1997 Moskovich
5,651,158 A 7/1997 Halm
D390,706 S 2/1998 Hohlbein et al.
5,735,012 A 4/1998 Heinzelman et al.
5,746,532 A 5/1998 Megill et al.
5,758,383 A 6/1998 Hohlbein
5,781,958 A 7/1998 Meessmann et al.
5,799,353 A 9/1998 Yamamoto et al.
5,802,656 A 9/1998 Dawson et al.
5,839,149 A 11/1998 Scheier et al.
D404,205 S 1/1999 Hohlbein
D404,206 S 1/1999 Hohlbein
5,862,559 A 1/1999 Hunter
5,863,102 A 1/1999 Waguespack et al.
5,908,038 A 6/1999 Bennett
5,915,868 A 6/1999 Frazell
5,930,860 A 8/1999 Shipp
5,946,758 A 9/1999 Hohlbein et al.
5,967,152 A 10/1999 Rimkus
5,970,564 A 10/1999 Inns et al.
5,984,935 A 11/1999 Budei et al.
5,991,958 A 11/1999 Hohlbein
6,015,293 A 1/2000 Rimkus
6,032,313 A 3/2000 Tsang
6,041,468 A 3/2000 Chen et al.
6,073,299 A 6/2000 Hohlbein
6,088,870 A 7/2000 Hohlbein
D429,887 S 8/2000 Hohlbein et al.
6,099,780 A 8/2000 Gellert
6,131,228 A 10/2000 Chen et al.
6,178,583 B1 1/2001 Volpenhein
6,234,798 B1 5/2001 Salazar et al.
6,276,021 B1 8/2001 Hohlbein
6,292,973 B1 9/2001 Moskovich et al.
D450,457 S 11/2001 Hohlbein
D450,929 S 11/2001 Angelini et al.
6,314,606 B1 11/2001 Hohlbein
D451,286 S 12/2001 Hohlbein
D456,138 S 4/2002 Hohlbein
D456,139 S 4/2002 Hohlbein
6,370,726 B1 4/2002 Kini et al.
D457,323 S 5/2002 Hohlbein
6,397,425 B1 6/2002 Szczech et al.
6,408,476 B1 6/2002 Cann
6,421,867 B1 7/2002 Weihrauch
D461,313 S 8/2002 Hohlbein
6,442,786 B2 9/2002 Halm
6,442,787 B2 9/2002 Hohlbein
D464,133 S 10/2002 Barnett et al.
6,463,618 B1 10/2002 Zimmer
D474,608 S 5/2003 Hohlbein
6,564,416 B1 5/2003 Claire et al.
6,596,213 B2 6/2003 Swenson
6,595,087 B2 7/2003 Whalen et al.
6,599,048 B2 7/2003 Kuo
6,601,272 B2 8/2003 Stvartak et al.
6,658,688 B2 12/2003 Gavney, Jr.
D486,649 S 2/2004 Sprosta et al.
6,687,940 B1 2/2004 Gross et al.
6,749,788 B1 6/2004 Holden et al.
6,766,549 B2 7/2004 Klupt
6,792,642 B2 9/2004 Wagstaff
6,820,299 B2 11/2004 Gavney, Jr.
6,820,300 B2 11/2004 Gavney, Jr.
6,859,969 B2 3/2005 Gavney, Jr. et al.
D503,538 S 4/2005 Desalvo
6,886,207 B1 5/2005 Solanki
6,889,405 B2 5/2005 Ritrovato et al.
6,919,038 B2 7/2005 Meyer et al.
6,957,469 B2 10/2005 Davies
D511,249 S 11/2005 Hohlbein
6,972,106 B2 12/2005 Huber et al.
D513,882 S 1/2006 Hohlbein et al.
6,983,507 B2 1/2006 McDougall
D514,320 S 2/2006 Hohlbein
D514,812 S 2/2006 Hohlbein et al.
6,996,870 B2 2/2006 Hohlbein
D516,819 S 3/2006 Hohlbein
D517,812 S 3/2006 Hohlbein et al.
D517,813 S 3/2006 Hohlbein et al.
7,007,332 B2 3/2006 Hohlbein
7,020,928 B2 4/2006 Hohlbein
D520,753 S 5/2006 Hohlbein
7,047,591 B2 5/2006 Hohlbein
7,069,615 B2 7/2006 Gavney, Jr.
7,073,225 B1 7/2006 Ford
D526,487 S 8/2006 Chenvainu et al.
7,083,756 B2 8/2006 Strahler
7,089,621 B2 8/2006 Hohlbein
D527,528 S 9/2006 Hohlbein
D528,803 S 9/2006 Hohlbein
D532,202 S 11/2006 Hohlbein
D532,607 S 11/2006 Hohlbein
7,143,462 B2 12/2006 Hohlbein
7,146,675 B2 12/2006 Ansari et al.
7,168,125 B2 1/2007 Hohlbein
7,181,799 B2 2/2007 Gavney, Jr. et al.
7,182,542 B2 2/2007 Hohlbein
7,213,288 B2 5/2007 Hohlbein
7,219,384 B2 5/2007 Hohlbein
7,273,327 B2 9/2007 Hohlbein et al.
D557,504 S 12/2007 Hohlbein
D557,505 S 12/2007 Hohlbein
7,322,067 B2 1/2008 Hohlbein
D562,560 S 2/2008 Hohlbein
7,331,731 B2 2/2008 Hohlbein et al.
7,354,112 B2 4/2008 Fischer et al.
7,383,619 B2 6/2008 Gross et al.
7,386,909 B2 6/2008 Hohlbein
7,415,788 B2 8/2008 Little
7,458,125 B2 12/2008 Hohlbein
7,472,448 B2 1/2009 Hohlbein et al.
7,478,959 B2 1/2009 Hohlbein
7,480,955 B2 1/2009 Hohlbein et al.
D589,260 S 3/2009 Hohlbein
7,540,844 B2 6/2009 Muser
D598,199 S 8/2009 Russell et al.
D598,654 S 8/2009 Huang
D599,556 S 9/2009 Russell et al.
7,614,111 B2 11/2009 Moskovich et al.
D609,915 S 2/2010 Erskine-Smith et al.
D612,611 S 3/2010 Brown, Jr. et al.
7,712,175 B2 5/2010 Blanchard et al.
7,721,376 B2 5/2010 Hohlbein et al.
7,722,274 B2 5/2010 Hohlbein et al.
7,735,174 B2 6/2010 Hohlbein et al.
D623,415 S 9/2010 Geiberger
7,788,756 B2 9/2010 Kraemer
7,845,042 B2 12/2010 Moskovich et al.
7,854,036 B2 12/2010 Georgi
7,937,794 B2 5/2011 Huber et al.
7,954,191 B2 6/2011 Hohlbein
7,958,589 B2 6/2011 Braun et al.
7,975,343 B2 7/2011 Hohlbein et al.
7,975,346 B2 7/2011 Moskovch et al.
7,979,947 B2 7/2011 Storkel et al.
8,032,991 B2 10/2011 Lawless
8,042,217 B2 10/2011 Sorrentino
8,046,864 B2 11/2011 Baertschi et al.
8,060,972 B2 11/2011 Geiberger et al.

(56) References Cited

U.S. PATENT DOCUMENTS

| | | | | |
|---|---|---|---|---|
| 8,083,980 | B2 | 12/2011 | Huber et al. | |
| 8,239,996 | B2 | 8/2012 | Garber et al. | |
| 8,307,488 | B2 | 11/2012 | Pfenniger et al. | |
| 8,327,492 | B2 | 12/2012 | Cann | |
| 8,332,982 | B2 | 12/2012 | Braun et al. | |
| 8,332,985 | B2 | 12/2012 | Solanki | |
| 8,382,208 | B2 | 2/2013 | Baertschi et al. | |
| 8,448,284 | B2 | 5/2013 | Gross et al. | |
| 8,448,287 | B2 | 5/2013 | Ponzini et al. | |
| 8,458,846 | B2 | 6/2013 | Schamberg et al. | |
| 8,484,789 | B2 | 7/2013 | Claire-Zimmet et al. | |
| 8,500,766 | B2 | 8/2013 | Jimenez et al. | |
| 8,528,148 | B2 | 9/2013 | Brown, Jr. et al. | |
| 8,595,886 | B2 | 12/2013 | Edelstein et al. | |
| 8,601,635 | B2 | 12/2013 | Goldman et al. | |
| 8,608,251 | B2 | 12/2013 | Nirwing et al. | |
| 8,621,698 | B2 | 1/2014 | Chenvainu et al. | |
| 8,631,534 | B2 | 1/2014 | Blanchard et al. | |
| 8,732,890 | B2 | 5/2014 | Mohr et al. | |
| 8,739,351 | B2 | 6/2014 | Kling et al. | |
| 8,776,302 | B2 | 7/2014 | Baertschi et al. | |
| 8,813,292 | B2 | 8/2014 | Driesen et al. | |
| 2002/0017003 | A1 | 2/2002 | Kramer et al. | |
| 2002/0138928 | A1 | 10/2002 | Calabrese | |
| 2003/0163881 | A1 | 9/2003 | Driesen et al. | |
| 2003/0178745 | A1 | 9/2003 | Scarabelli et al. | |
| 2003/0178885 | A1 | 9/2003 | Weihrauch | |
| 2004/0025275 | A1 | 2/2004 | Moskovich et al. | |
| 2004/0107521 | A1 | 6/2004 | Chan et al. | |
| 2004/0134007 | A1 | 7/2004 | Davies | |
| 2004/0154112 | A1* | 8/2004 | Braun | A46B 15/0002 15/22.1 |
| 2005/0102783 | A1* | 5/2005 | Hohlbein | A46B 9/04 15/167.1 |
| 2005/0166343 | A1 | 8/2005 | Gavney, Jr. | |
| 2005/0210612 | A1 | 9/2005 | Hohlbein et al. | |
| 2006/0048314 | A1 | 3/2006 | Kressner | |
| 2006/0048323 | A1 | 3/2006 | Rueb | |
| 2006/0064827 | A1 | 3/2006 | Chan | |
| 2006/0123574 | A1 | 6/2006 | Storkel et al. | |
| 2006/0236477 | A1* | 10/2006 | Gavney, Jr. | A46B 11/063 15/97.1 |
| 2006/0236478 | A1 | 10/2006 | Hohlbein et al. | |
| 2006/0248667 | A1 | 11/2006 | Kraemer | |
| 2007/0151058 | A1 | 7/2007 | Kraemer et al. | |
| 2007/0169295 | A1 | 7/2007 | Winter et al. | |
| 2007/0265555 | A1 | 11/2007 | Deng | |
| 2007/0283517 | A1 | 12/2007 | Blanchard et al. | |
| 2009/0007357 | A1* | 1/2009 | Meadows | A46B 9/005 15/167.1 |
| 2009/0038097 | A1 | 2/2009 | Geiberger | |
| 2009/0158543 | A1 | 6/2009 | Lee | |
| 2009/0255077 | A1 | 10/2009 | Mori et al. | |
| 2010/0043162 | A1 | 2/2010 | Kling et al. | |
| 2010/0058550 | A1 | 3/2010 | Ballmaier et al. | |
| 2010/0088836 | A1 | 4/2010 | Kirchhofer et al. | |
| 2010/0101037 | A1 | 4/2010 | Hilfiker et al. | |
| 2010/0115724 | A1 | 5/2010 | Huang | |
| 2010/0180392 | A1 | 7/2010 | Binet et al. | |
| 2010/0223746 | A1 | 9/2010 | Mueller | |
| 2010/0263149 | A1 | 10/2010 | Ballmaier et al. | |
| 2010/0306941 | A1 | 12/2010 | Erskine-Smith et al. | |
| 2011/0030160 | A1 | 2/2011 | Knutzen et al. | |
| 2011/0047736 | A1* | 3/2011 | Jimenez | A46B 9/04 15/167.2 |
| 2011/0109149 | A1* | 5/2011 | Loetscher | A46B 3/00 300/21 |
| 2011/0138560 | A1 | 6/2011 | Vitt et al. | |
| 2011/0219558 | A1 | 9/2011 | Vitt et al. | |
| 2012/0034576 | A1 | 2/2012 | Mostafa | |
| 2012/0192369 | A1 | 8/2012 | Mohr et al. | |
| 2012/0266400 | A1* | 10/2012 | Jimenez | A46B 9/04 15/105 |
| 2013/0007968 | A1 | 1/2013 | Driesen et al. | |
| 2013/0036566 | A1 | 2/2013 | Schlatter | |
| 2013/0139338 | A1 | 6/2013 | Hess et al. | |
| 2013/0269128 | A1 | 10/2013 | Jimenez | |
| 2013/0291320 | A1 | 11/2013 | Kirchhofer et al. | |
| 2013/0333126 | A1 | 12/2013 | Miller | |
| 2014/0047656 | A1 | 2/2014 | Newman et al. | |
| 2014/0158152 | A1 | 6/2014 | Kirchhofer et al. | |
| 2014/0173838 | A1 | 6/2014 | Dickie et al. | |
| 2014/0173853 | A1 | 6/2014 | Kirchhofer et al. | |
| 2014/0298605 | A1 | 10/2014 | Ivory | |
| 2014/0310901 | A1 | 10/2014 | Geiberger et al. | |
| 2015/0327665 | A1 | 11/2015 | Hohlbein | |
| 2015/0327666 | A1 | 11/2015 | Hohlbein | |

FOREIGN PATENT DOCUMENTS

| | | | | |
|---|---|---|---|---|
| BR | 7900283 | | 8/2000 | |
| BR | DI 6601454-9 | | 4/2006 | |
| BR | DI 6702593 | | 8/2007 | |
| BR | DI 6805210-3 | | 11/2008 | |
| BR | DI 6902120-1 | | 5/2009 | |
| BR | DI 6903329-3 | | 8/2009 | |
| BR | DI 6903330-7 | | 8/2009 | |
| BR | DI 6904386 | | 11/2009 | |
| BR | DI 7102178-7 | | 4/2011 | |
| BR | 30 2013 000448-1 | | 2/2013 | |
| BR | DI 6401609-9 | | 5/2014 | |
| CA | 2892499 | * | 6/2014 | A46B 9/025 |
| CH | 215110 | | 6/1941 | |
| CN | 3372860D | | 6/2004 | |
| CN | 3372861D | | 6/2004 | |
| CN | 2732059 | | 10/2005 | |
| CN | 300704339 | | 10/2007 | |
| CN | 201294969 | | 8/2009 | |
| CN | 201518876 | | 7/2010 | |
| CN | 201518877 | | 7/2010 | |
| CN | 201518880 | | 7/2010 | |
| CN | 201528796 | | 7/2010 | |
| CN | 201541995 | | 8/2010 | |
| CN | 201541996 | | 8/2010 | |
| CN | 201541997 | | 8/2010 | |
| CN | 201550827 | | 8/2010 | |
| CN | 301406316 | S | 12/2010 | |
| CN | 301421505 | S | 12/2010 | |
| CN | 1738560 | | 1/2011 | |
| CN | 201814085 | | 5/2011 | |
| CN | 201986933 | | 9/2011 | |
| CN | 301763519 | | 12/2011 | |
| CN | 30198826 | | 5/2012 | |
| CN | 302058056 | | 9/2012 | |
| CN | 302225957 | S | 12/2012 | |
| CN | 302328863 | S | 2/2013 | |
| CN | 202800555 | | 3/2013 | |
| CN | 103005839 | | 4/2013 | |
| CN | 203194906 | | 9/2013 | |
| CN | 203220069 | | 10/2013 | |
| CN | 203220073 | | 10/2013 | |
| CN | 203252150 | | 10/2013 | |
| CN | 302956580 | S | 10/2014 | |
| CN | 102740730 | | 4/2015 | |
| DE | 19858102 | | 6/2000 | |
| DE | 202005009026 | | 10/2005 | |
| DE | 102006016939 | | 5/2007 | |
| DE | 102006005616 | | 8/2007 | |
| DE | 102006024874 | | 11/2007 | |
| DE | 202008016004 | | 2/2009 | |
| DE | 102014002960 | | 9/2014 | |
| EM | 000366984-0001 | | 7/2005 | |
| EM | 000638028-0002 | | 12/2006 | |
| EM | 001975079-0005 | | 1/2012 | |
| EM | 002163675-0002 | | 1/2013 | |
| EM | 002163675-0003 | | 1/2013 | |
| EM | 002212522-0004 | | 4/2013 | |
| EM | 002212522-0012 | | 4/2013 | |
| EM | 002424069-0001 | | 3/2014 | |
| EP | 0716821 | | 6/1996 | |
| EP | 0769920 | | 9/2003 | |
| EP | 2810581 | | 12/2014 | |
| ES | 1063617 | | 11/2006 | |

(56) References Cited

FOREIGN PATENT DOCUMENTS

| | | |
|---|---|---|
| IT | 2010PDO000035-0019 | 10/2010 |
| JP | H08164025 | 6/1996 |
| JP | 10042957 | 8/1996 |
| JP | D1314270 | 10/2007 |
| KR | 20040032038 | 4/2004 |
| KR | 838174 | 6/2007 |
| KR | 20-2012-0005449 | 7/2012 |
| MX | 32553 | 11/2009 |
| MX | 36113 | 4/2011 |
| MX | 36650 | 4/2011 |
| RU | 55985 | 1/2005 |
| RU | 79787 | 10/2011 |
| RU | 80086 | 11/2011 |
| RU | 81915 | 6/2012 |
| TW | 201446184 | 12/2014 |
| WO | WO1995/06420 | 3/1995 |
| WO | WO1995/10959 | 4/1995 |
| WO | WO1999/023910 | 5/1999 |
| WO | WO1999/55514 | 11/1999 |
| WO | WO1999/65358 | 12/1999 |
| WO | WO2000/49911 | 8/2000 |
| WO | WO2001/17392 | 3/2001 |
| WO | WO2001/29128 | 4/2001 |
| WO | WO2001/45573 | 6/2001 |
| WO | WO2001/182741 | 11/2001 |
| WO | WO2004/043669 | 5/2004 |
| WO | WO2005/122827 | 12/2005 |
| WO | WO2008/017996 | 2/2008 |
| WO | WO2011/070549 | 6/2011 |
| WO | WO2012/017923 | 2/2012 |
| WO | WO2012/115035 | 8/2012 |
| WO | WO2012/176741 | 12/2012 |
| WO | WO2013/031685 | 3/2013 |

OTHER PUBLICATIONS

International Search Report and the Written Opinion issued in International Application PCT/US2012/070760 dated Oct. 14, 2013.

International Search Report and the Written Opinion of the International Searching Authority issued in International Application PCT/US2014/072036 dated Nov. 20, 2015.

* cited by examiner

ORAL CARE IMPLEMENT

BACKGROUND

A toothbrush is used to clean the teeth by removing plaque and debris from the tooth surfaces. Conventional toothbrushes having a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and the teeth. As a result, the dentifrice is often spread around the mouth, rather than being concentrated on the contact of the bristles with the teeth. Therefore, the efficiency of the cleaning process is reduced.

While substantial efforts have been made to modify the cleaning elements of toothbrushes to improve the efficiency of the oral cleaning process, the industry continues to pursue arrangements of cleaning elements that will improve upon the existing technology. In typical oral care implements, bristles having circular transverse cross-sectional profiles are bundled together in a bristle tuft and mounted within tuft holes having circular transverse cross-sectional profiles. However, such a configuration results in gaps being present between adjacent bristles in the tuft and between the bristles of the tuft and the walls of the tuft holes, thereby resulting in a looser packing of the tuft hole and a less than optimal packing factor. These gaps can also reduce the effectiveness of the oral care implement and can cause the oral care implement to effectuate an uncomfortable feeling during brushing. Therefore, a need exists for an oral care implement having an improved arrangement of bristles.

BRIEF SUMMARY

The present invention is directed to an oral care implement that includes a handle and a head with a front surface. A plurality of tooth cleaning elements extend from the front surface. The plurality of tooth cleaning elements include a conical tuft that is formed by a continuous wall of bristles. The conical tuft has an inner surface that defines a cavity. The cavity has a transverse cross-sectional area that increases with distance from the front surface of the head. A central cleaning element may also be located within the cavity. The conical tuft may have an annular top surface that undulates in height relative to the front surface of the head. Furthermore, in some embodiments arcuate cleaning elements may be arranged in a loop that surrounds the conical tuft.

In one aspect, the invention can be an oral care implement comprising: a handle; a head coupled to the handle, the head comprising a front surface; a plurality of tooth cleaning elements extending from the front surface of the head; the plurality of tooth cleaning elements comprising a conical tuft comprising a continuous bristle wall having an inner surface defining a cavity along a cavity axis, the cavity having a transverse cross-sectional area that increases with distance from the front surface of the head; and the plurality of tooth cleaning elements comprising a central cleaning element located within the conical cavity.

In another aspect, the invention can be an oral care implement comprising: a handle; a head coupled to the handle, the head comprising a front surface; a plurality of tooth cleaning elements extending from the front surface of the head; the plurality of tooth cleaning elements comprising a conical tuft comprising a bristle wall having an inner surface defining a cavity along a cavity axis, the cavity having a transverse cross-sectional area that increases with distance from the front surface of the head; and wherein the bristle wall of the conical tuft terminates in an annular top surface that undulates in height relative to the front surface.

In yet another aspect, the invention can be an oral care implement comprising: a handle; a head coupled to the handle, the head comprising a front surface; a plurality of tooth cleaning elements extending from the front surface of the head; the plurality of tooth cleaning elements comprising a conical tuft comprising a bristle wall having an inner surface defining a cavity along a cavity axis, the cavity having a transverse cross-sectional area that increases with distance from the front surface of the head; and the plurality of tooth cleaning elements comprising a plurality of arcuate cleaning elements arranged in a spaced apart manner about a loop that surrounds the conical tuft.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
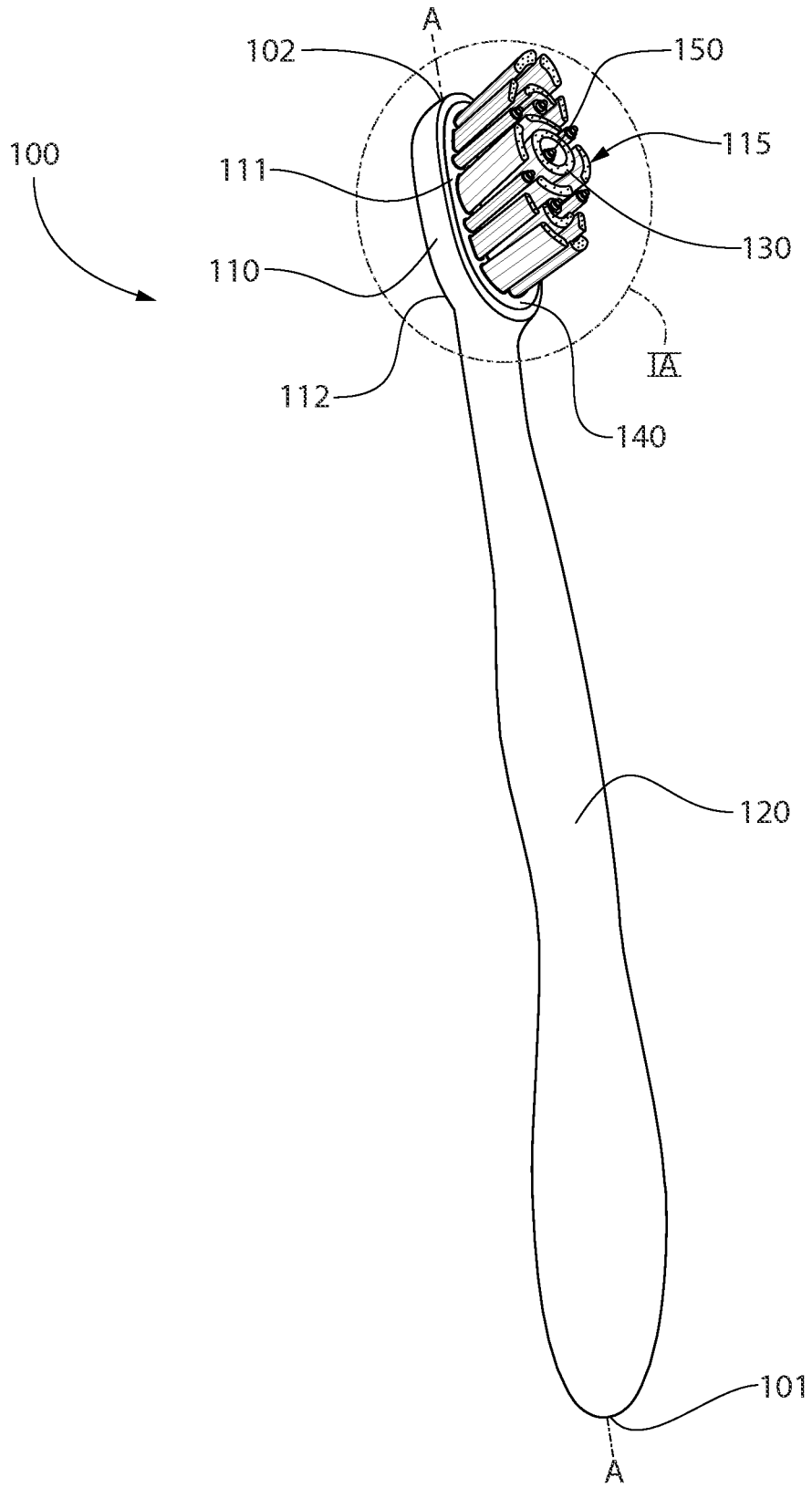
FIG. 1 is a front perspective view of an oral care implement in accordance with one embodiment of the present invention.
Figure 1A:
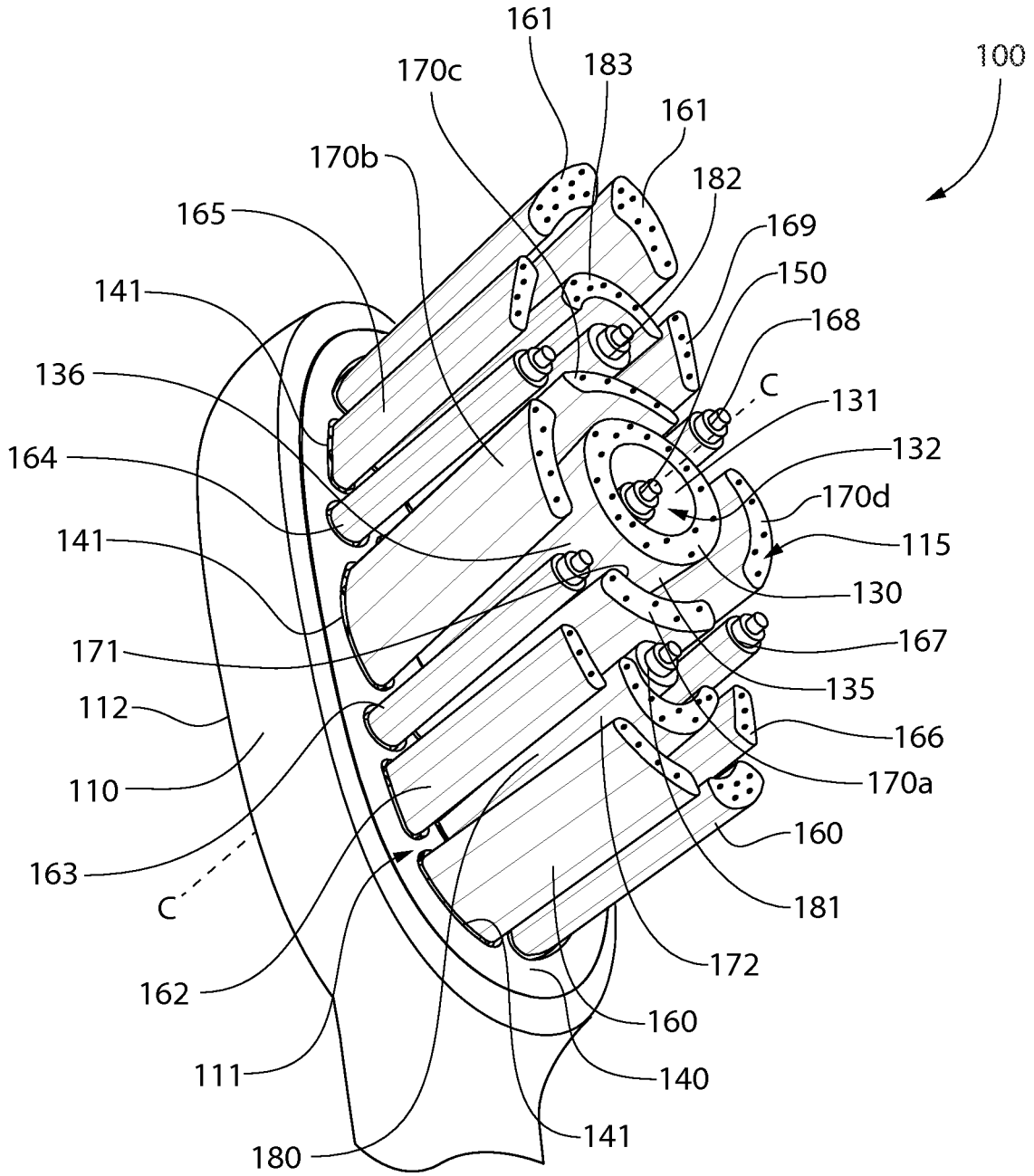
FIG. 1A is a close-up view of area IA of FIG. 1.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
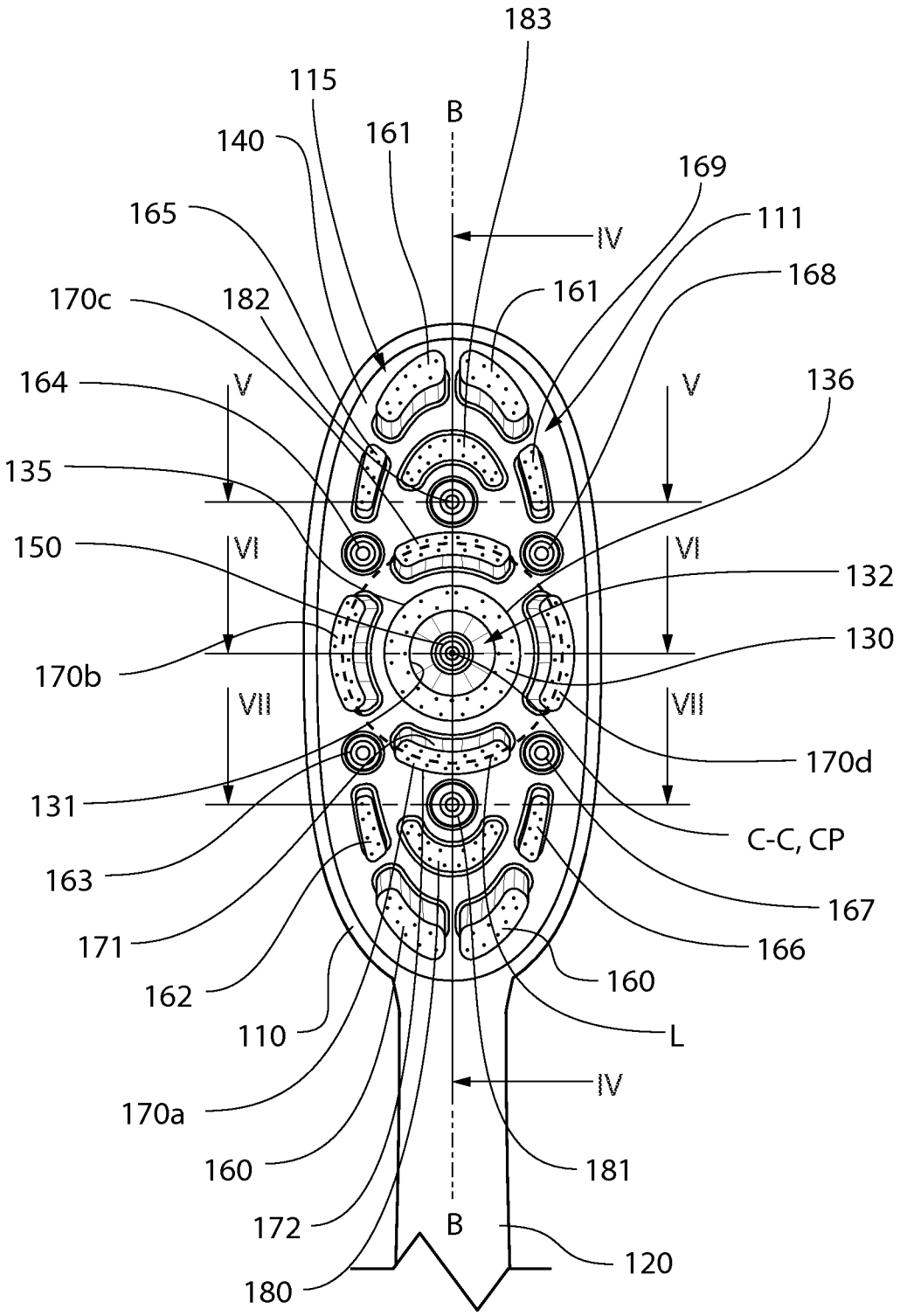
FIG. 2 is a front view of the head of the oral care implement of FIG. 1A.
Figure 3:
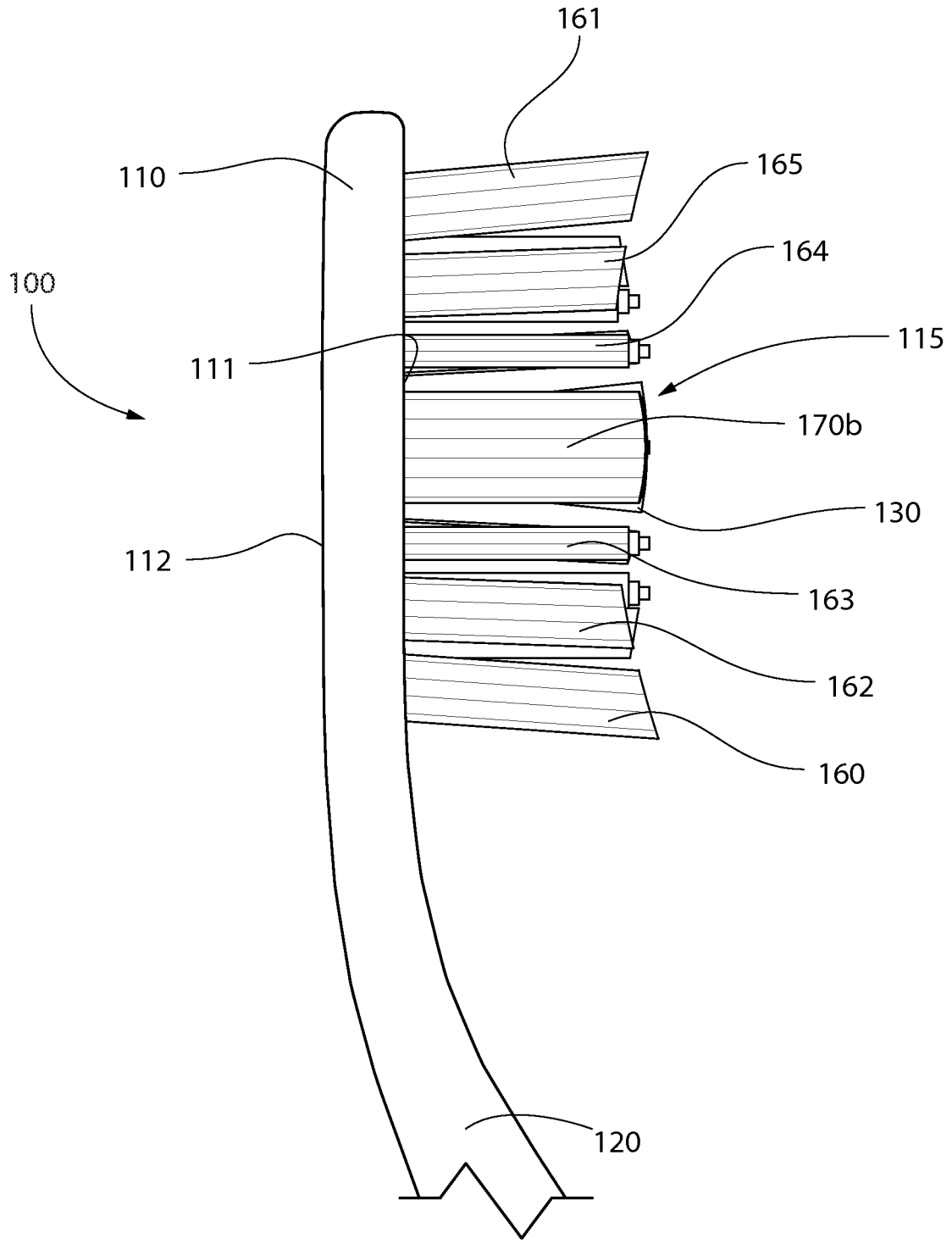
FIG. 3 is a side view of the head of the oral care implement of FIG. 1A.

Referring first to FIGS. 1-3 concurrently, an oral care implement 100 is illustrated in accordance with one embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement extends from a proximal end 101 to a distal end 102 along a longitudinal axis A-A. The oral care implement 100 generally comprises a head 110 and a handle 120. The handle 120 is an elongated structure that provides the mechanism by which the user can hold and manipulate the oral care implement 100 during use. In the exemplified embodiment, the handle 120 is generically depicted having various contours for user comfort. Of course, the invention is not to be limited by the specific shape illustrated for the handle 120 in all embodiments and in certain other embodiments the handle 120 can take on a wide variety of shapes, contours, and configurations, none of which are limiting of the present invention unless so specified in the claims.

In the exemplified embodiment, the handle 120 is formed of a rigid plastic material, such as for example without limitation polymers and copolymers of ethylene, propylene, butadiene, vinyl compounds, and polyesters such as polyethylene terephthalate. Of course, the invention is not to be so limited in all embodiments and the handle 120 may include a resilient material, such as a thermoplastic elastomer, as a grip cover that is molded over portions of or the entirety of the handle 120 to enhance the gripability of the handle 120 during use. For example, portions of the handle 120 that are typically gripped by a user's palm during use may be overmolded with a thermoplastic elastomer or other resilient material to further increase comfort to a user. Furthermore, materials other than those noted above can be used including metal, wood or any other desired material that has sufficient structural rigidity to permit a user to grip the handle 120 and manipulate the oral care implement 100 during toothbrushing.

The head 110 of the oral care implement 100 is coupled to the handle 120 and comprises a front surface 111 and an opposing rear surface 112. In the exemplified embodiment, the head 110 is formed integrally with the handle 120 as a single unitary structure using a molding, milling, machining, or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus the head 110 may, in certain embodiments, be formed of any of the rigid plastic materials described above as being used for forming the handle 120, although the invention is not to be so limited in all embodiments and other materials that are commonly used during toothbrush head manufacture may also be used.

The oral care implement 100 also comprises a plurality of tooth cleaning elements 115 extending from the front surface 111 of the head 110. The details of certain ones of the plurality of tooth cleaning elements 115 will be discussed below, including specific details with regard to structure, pattern, orientation, and material of such tooth cleaning elements 115. However, where it does not conflict with the other disclosure provided herein, it should be appreciated that the term "tooth cleaning elements" may be used in a generic sense to refer to any structure that can be used to clean, polish, or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Thus, any combination of these tooth cleaning elements may be used within the tooth cleaning elements 115 in some embodiments. However, as described herein below, in certain embodiments one or more of the tooth cleaning elements 115 may be formed as tufts of bristles.

In embodiments that use elastomeric elements as one or more of the tooth cleaning elements 115, suitable elastomeric materials may include any biocompatible resilient material suitable for uses in an oral hygiene apparatus. To provide optimum comfort as well as cleaning benefits, the elastomeric material of any such tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Referring to FIGS. 1-7 concurrently, one manner in which the tooth cleaning elements 115 are secured to the head 110 will be described. Specifically, in the exemplified embodiment the tooth cleaning elements 115 are formed as a cleaning element assembly on a head plate 140 such that one or more of the tooth cleaning elements 115 are mounted onto the head plate 140 and then the head plate 140 is coupled to the head 110. In such an embodiment, the head plate 140 is a separate and distinct component from the head 110 of the oral care implement 100. However, the head plate 140 is connected to the head 110 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 140 and the head 110 are separately formed components that are secured together during manufacture of the oral care implement 100.

In certain embodiments, the head plate 140 may comprise a plurality of holes 141 formed therethrough, and the tooth cleaning elements 115 may be mounted to the head plate 140 within the holes 141. This type of technique for mounting the tooth cleaning elements 115 to the head 110 via the head plate 140 is generally known as anchor free tufting (AFT). Specifically, in AFT a plate or membrane (i.e., the head plate 140) is created separately from the head 110. The tooth cleaning elements 115 (such as bristles, elastomeric elements, and combinations thereof) are positioned into the head plate 140 so as to extend through the holes 141 of the head plate 140. The free ends of the tooth cleaning elements 115 on one side of the head plate 140 perform the cleaning function. The ends of the tooth cleaning elements 115 on the other side of the head plate 140 are melted together by heat to be anchored in place. As the tooth cleaning elements 105 are melted together, a melt matte 106 is formed. After the tooth cleaning elements 115 are secured to the head plate 140, the head plate 140 is secured to the head 110 such as by ultrasonic welding. When the head plate 140 is coupled to the head 110, the melt matte 106 is located between a lower surface 142 of the head plate 140 and a floor 107 of a basin 108 of the head 110 in which the head plate 140 is disposed. The melt matte 106, which is coupled directly to and in fact forms a part of the tooth cleaning elements 115, prevents the tooth cleaning elements 115 from being pulled through the holes 141 in the head plate 140 thus ensuring that the tooth cleaning elements 105 remain attached to the head plate 140 during use of the oral care implement 100.

Of course, techniques other than AFT can be used for mounting the tooth cleaning elements 115 to the head 110, such as widely known and used stapling techniques or the like. In such embodiments the head plate 140 may be omitted and the tooth cleaning elements 115 may be coupled directly to the head 110. Furthermore, in a modified version of the AFT process discussed above, the head plate 140 may be formed by positioning the tooth cleaning elements 115 within a mold, and then molding the head plate 140 around the tooth cleaning elements 115 via an injection molding process.

Although described herein above with regard to using AFT, in certain embodiments any suitable form of cleaning elements and attachment may be used in the broad practice of this invention. Specifically, the tooth cleaning elements 115 of the present invention can be connected to the head 110 in any manner known in the art. For example, staples/anchors or in-mold tufting (IMT) could be used to mount the cleaning elements/tooth engaging elements. In certain embodiments, the invention can be practiced with various combinations of stapled, IMT or AFT bristles. Alternatively, the tooth cleaning elements 115 could be mounted to tuft blocks or sections by extending through suitable openings in the tuft blocks so that the base of the tooth cleaning elements 115 is mounted within or below the tuft block.

Although not illustrated herein, in certain embodiments the head 110 may also include a soft tissue cleanser coupled to or positioned on its rear surface 112. An example of a suitable soft tissue cleanser that may be used with the present invention and positioned on the rear surface of the head 110 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

With continued reference to FIGS. 1-7, the oral care implement 100, and specifically the tooth cleaning elements 115 of the oral care implement 100, will be further described. In the exemplified embodiment, the plurality of tooth cleaning elements 115 comprises a conical tuft 130. The conical tuft 130 is a tuft or grouping of bristles that are arranged together into a tuft and then secured into a single tuft hole within the head 110 (or within the head plate 140). The conical tuft 130 is described herein as being conical due to the conical tuft 130 having a conical shape. More specifically, as can best be seen in FIG. 6, the conical tuft 130 is in the shape of a truncated cone wherein the portion of the conical tuft 130 that is positioned within the head 110 is the truncated (i.e., cut off) portion of the cone such that the conical tuft 130 is in the shape of an inverted truncated cone.

The conical tuft 130 comprises a continuous bristle wall 135 having an inner surface 131 and an outer surface 136. The inner surface 131 of the continuous bristle wall 135 of the conical tuft 130 defines a cavity 132 that extends along a cavity axis C-C. The conical tuft 130 extends in a 360° manner about the cavity axis C-C. The cavity 132 of the conical tuft 130 has an open top end and is bounded by the inner surface 131 of the continuous bristle wall 135 and by the front surface 111 of the head 110. As noted above, the conical tuft 130 in the exemplified embodiment is formed by a plurality of bristles. Specifically, in the exemplified embodiment the plurality of bristles are clumped together and positioned collectively into a single tuft hole so that the plurality of bristles collectively form the conical tuft 130 having no gaps in the continuous bristle wall 135 for its entire 360° extension about the cavity axis C-C. Thus, the term continuous bristle wall 135 is intended to mean that the conical tuft 130 is a single tuft of bristles that are clumped together into a single tuft hole in a non-spaced apart manner.

Thus, in the exemplified embodiment the conical tuft 130 is a single bristle tuft formed from a plurality of individual bristles that are positioned together within a single tuft hole. As a result, the conical tuft 130 has the continuous bristle wall 135 that extends without discontinuity about the cavity axis C-C. Thus, in the exemplified embodiment there are no gaps formed into the outer surface 136 of the conical tuft 130. Of course, in other embodiments the conical tuft 130 may have small gaps therein as desired while still being a single tuft positioned within a single tuft hole. Such gaps in the bristle wall may prevent dentifrice from being trapped within the cavity 132 of the conical tuft 130 by providing means of egress from the cavity 132. In such embodiments, the bristle wall 135 of the conical tuft 130 may not be continuous.

Due to the conical shape of the conical tuft 130, and more specifically, the inverted conical shape of the conical tuft 130, the cavity 132 of the conical tuft 130 has a transverse cross-sectional area that increases with distance from the front surface 111 of the head 110. Specifically, the transverse cross-sectional area of the cavity 132 of the conical tuft 130 only increases and never decreases with distance from the front surface 111 of the head 110. Thus, the greater the distance between a particular axial location within the cavity 132 of the conical tuft 130 and the front surface 111 of the head 110, the greater the transverse cross-sectional area of the cavity 132 at that particular axial location.

In addition to the conical tuft 130, in the exemplified embodiment the oral care implement 100 comprises a central cleaning element 150 that is located within the cavity 132 of the conical tuft 130. Thus, the conical tuft 130 surrounds the central cleaning element 150. Of course, the central cleaning element 150 may be omitted in certain other embodiments if desired. However, using the conical tuft 130 in conjunction with the central cleaning element 150 may enhance cleaning by enabling the conical tuft 130 to surround a user's tooth while the central cleaning element 150 cleans in the interproximal areas and the spaces between the teeth and gums. In the exemplified embodiment, the central cleaning element 150 is a bristle tuft, although the invention is not to be so limited in all embodiments and in certain other embodiments the central cleaning element 150 may be an elastomeric element or the like as discussed above. Furthermore, the central cleaning element 150 may be formed with tapered bristles, rounded/non-tapered bristles, spiral bristles, or combinations thereof. As discussed above, in the exemplified embodiment the conical tuft 130 and the central cleaning element 150 are secured to the head 110 by anchor free tufting. Specifically, the ends of the bristles that form the conical tuft 130 and the ends of the bristles that form the central cleaning element 150 are melted together to form at least a portion of the melt matte 106 as discussed above.

In the exemplified embodiment the conical tuft 130 and the central cleaning element 150 extend from a single tuft hole 134. Of course, the invention is not to be so limited in all embodiments and in certain other embodiments the conical tuft 130 and the central cleaning element 150 may extend from different tuft holes that are spaced apart from one another such that the tuft hole of the conical tuft 130 may substantially (or concentrically) surround the tuft hole of the central cleaning element 150. Furthermore, in the exemplified embodiment the central cleaning element 150 and the conical tuft 130 extend substantially the same distance from the front surface 111 of the head 110. Of course, the invention is not to be so limited and in certain other embodiments the central cleaning element 150 may have a height that is greater than a height of the conical tuft 130 or the conical tuft 130 may have a height that is greater than the height of the central cleaning element 150.

In the exemplified embodiment, the central cleaning element 150 is aligned along the cavity axis C-C and the central cleaning element 150 is circumferentially spaced apart from the inner surface 131 of the conical tuft 130 by an annular gap 133. In the exemplified embodiment, the central cleaning element 150 is centrally positioned within the cavity 132. However, due to the conical shape of the conical tuft 130, the width of the annular gap 133 increases with distance from the front surface 111 of the head 110. Thus, the width of the annular gap 133 (or the distance between the inner surface 131 of the conical tuft 130 and the outer surface of the central cleaning element 150) is greater at the terminal ends or cleaning ends of the conical tuft 130 and central cleaning element 150 than at the front surface 111 of the head 110.

Figure 4:
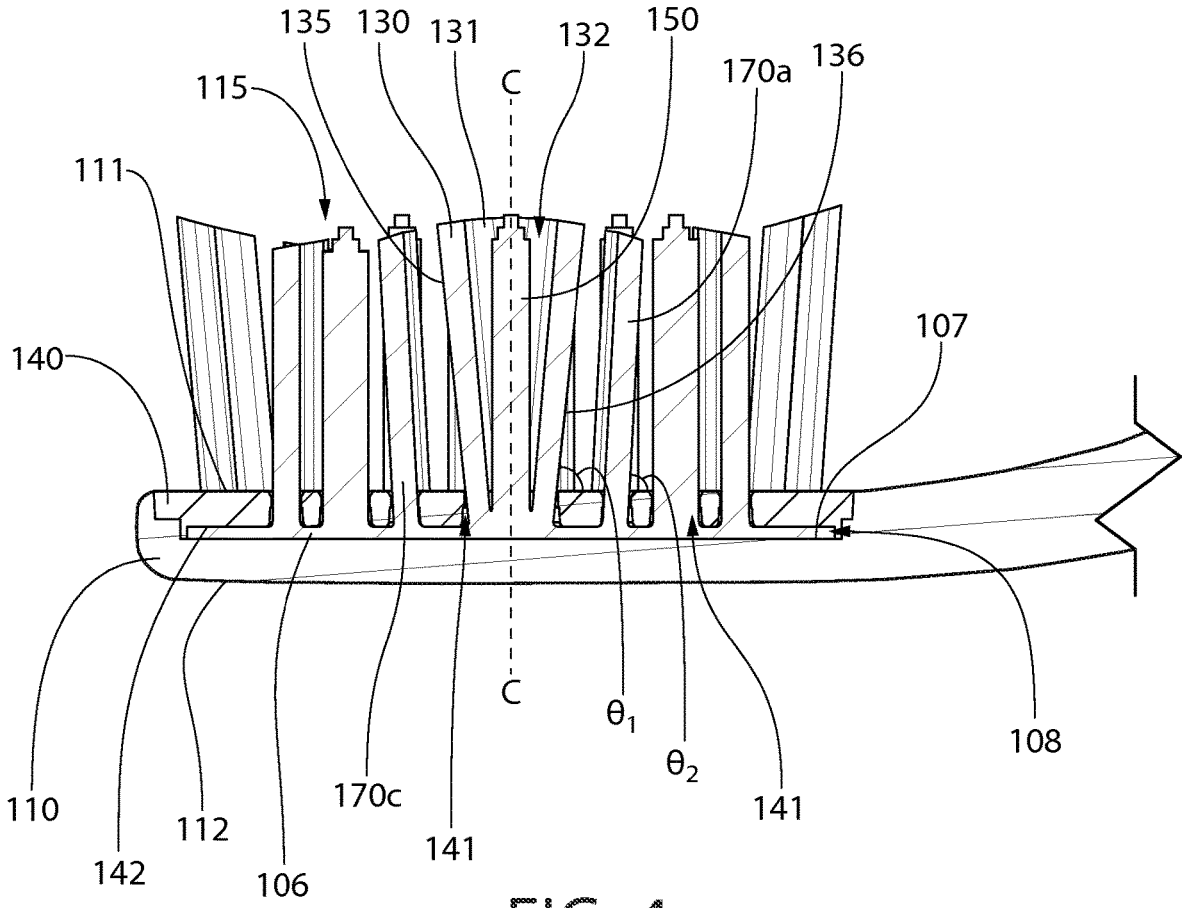
FIG. 4 is a cross-sectional view taken along line IV-IV of FIG. 2.
Figure 5:
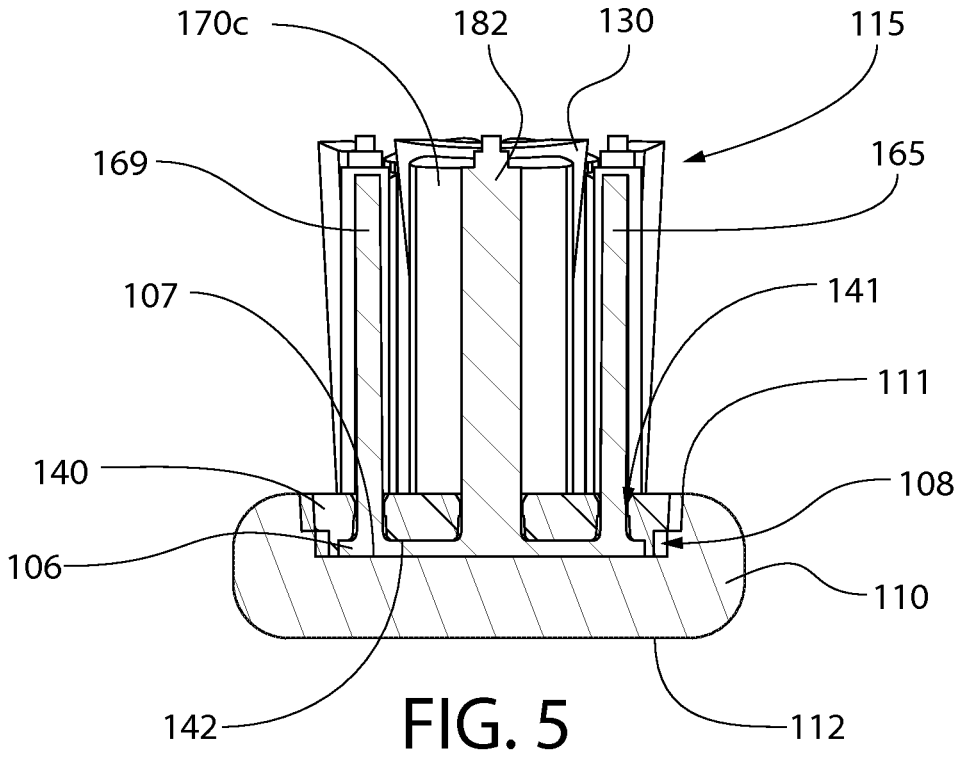
FIG. 5 is a cross-sectional view taken along line V-V of FIG. 2.
Figure 6:
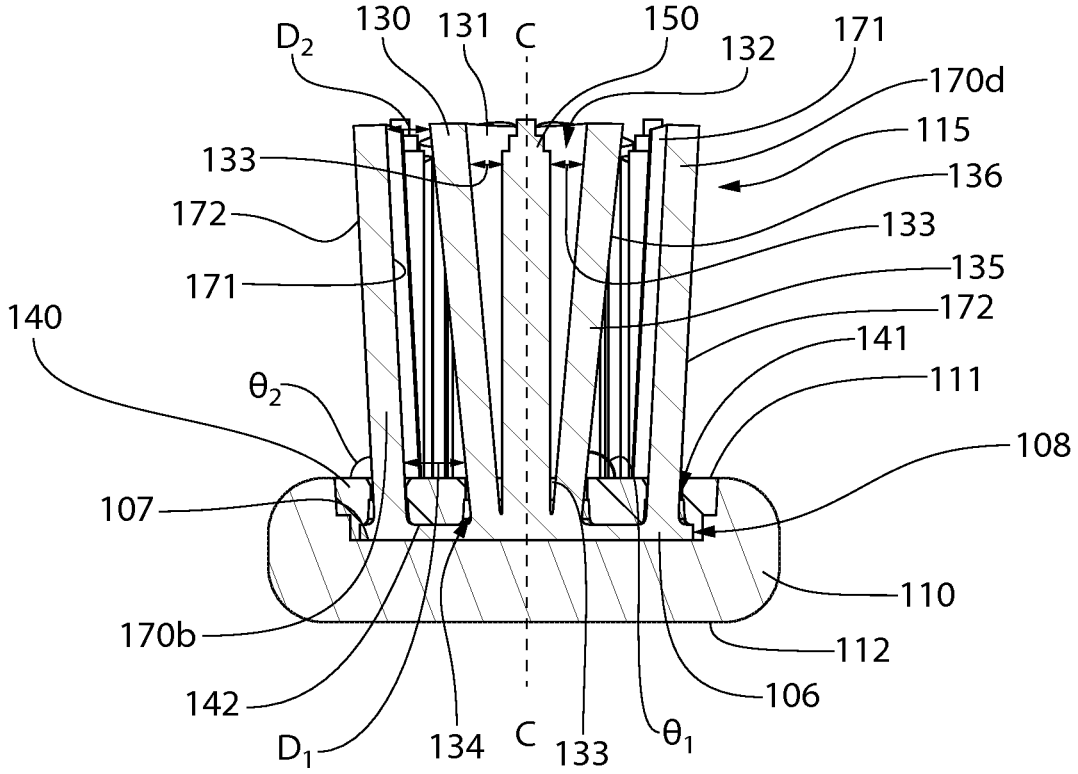
FIG. 6 is a cross-sectional view taken along line VI-VI of FIG. 2.
Figure 7:
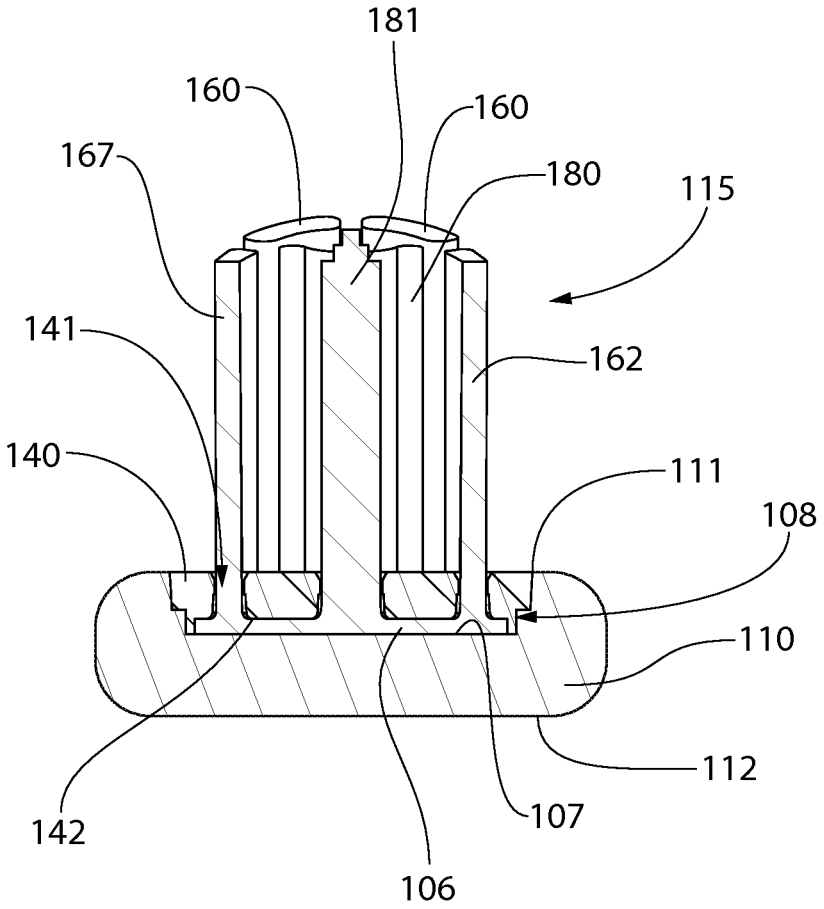
FIG. 7 is a cross-sectional view taken along line VII-VII of FIG. 2.

The conical tuft 130 circumferentially surrounds the central cleaning element 150 in a spaced apart manner for at least the portion of the conical tuft 130 and the central cleaning element 150 that extend above the front surface 111 of the head 110. However, as best seen in FIGS. 4 and 6, the central cleaning element 150 converges with the continuous bristle wall 135 of the conical tuft 130 at a position that is below the front surface 111 of the head 110. Specifically, the central cleaning element 150 and the conical tuft 130 converge into contact with one another at a location below the front surface 111 of the head 110 to form the melt matte 106 as discussed above.

Thus, the annular gap 133 formed between the inner surface 131 of the conical tuft 130 and the central cleaning element 150 extends to below the front surface 111 of the head 110. Stated another way, the annular gap 133 exists between the inner surface 131 of the conical tuft 130 and the central cleaning element 150 for the entire portion of the conical tuft 130 and the central cleaning element 150 that extends from or protrudes beyond the front surface 111 of the head 110. Due to the annular gap 133 extending to below the front surface 111 of the head 110, independent movement of the conical tuft 130 and the central cleaning element 150 is enhanced or improved. Specifically, because the conical tuft 130 and the central cleaning element 150 converges at the very bottom portion of those bristle tufts, the conical tuft 130 and the central cleaning element 150 are spaced apart along their lengths to enable independent movement thereof. This better enables the conical tuft 130 to surround a user's teeth individually during tooth brushing due to the increased flexibility of the conical tuft 130.

The head 110 extends along a longitudinal axis B-B along its length. In the exemplified embodiment, the conical tuft 130 and the central cleaning element 150 are aligned on the longitudinal axis. Furthermore, in the exemplified embodiment the conical tuft 130 and the central cleaning element 150 are also aligned along a transverse axis that is perpendicular to the longitudinal axis B-B and that divides the head 110 into two equal halves. Thus, in the exemplified embodiment the conical tuft 130 and the central cleaning element 150 are centrally located on the head 110. Of course, in other embodiments the conical tuft 130 and the central cleaning element 150 can be positioned at other located on the head 110 as desired.

The plurality of tooth cleaning elements 115 also include a plurality of arcuate cleaning elements **170*a-d* that are arranged in a spaced apart manner about a loop L that surrounds the conical tuft 130. In the exemplified embodiment, the plurality of arcuate cleaning elements 170*a-d* are depicted as tufts of bristles. However, the plurality of arcuate cleaning elements 170*a-d* can be formed from an elastomeric material in other embodiments as desired. Furthermore, the plurality of arcuate cleaning elements 170*a-d* are positioned adjacent to the conical tuft 130 such that there are no other cleaning element structures intervening in the spaces between the plurality of arcuate cleaning elements 170*a-d* and the conical tuft 130. Thus, each of the plurality of arcuate cleaning elements 170*a-d* is positioned adjacent to the conical tuft 130 in a spaced apart manner such that the space between the plurality of arcuate cleaning elements 170*a-d* and the conical tuft 130** is devoid of cleaning elements.

The loop L is a reference loop that is delineated in dotted lines in FIG. 2 for reference. The loop L has a center point CP that is located along the cavity axis C-C. The center point CP is also the point of intersection between the longitudinal axis B-B and the transverse axis discussed above that divides the head 110 into two equal halves. Thus, the loop L and the conical tuft 130 are arranged concentrically about the cavity axis C-C with the loop L having a greater diameter than the conical tuft 130. The plurality of arcuate cleaning elements 170*a-d* include a first arcuate cleaning element 170*a*, a second arcuate cleaning element 170*b*, a third arcuate cleaning element 170*c*, and a fourth arcuate cleaning element 170*d*. The first arcuate cleaning element 170*a* is positioned adjacent to and spaced apart from each of the second and fourth arcuate cleaning elements 170*b*, 170*d*. The second arcuate cleaning element 170*b* is positioned adjacent to and spaced apart from each of the first and third arcuate cleaning elements 170*a*, 170*c*. The third arcuate cleaning element 170*c* is positioned adjacent to and spaced apart from each of the second and fourth arcuate cleaning elements 170*b*, 170*d*. The fourth arcuate cleaning element 170*d* is positioned adjacent to and spaced apart from each of the first and third arcuate cleaning elements 170*a*, 170*c*.

Each of the plurality of arcuate cleaning elements 170*a-d* is an elongated bristle wall. Specifically, the first and third arcuate cleaning elements 170*a, c* are elongated in a direction transverse to the longitudinal axis B-B of the head 110 and the second and fourth arcuate cleaning elements 170*b, d* are elongated in a direction parallel to the longitudinal axis B-B. Each of the plurality of arcuate cleaning elements 170*a-d* is formed from a plurality of individual bristles that are arranged together into a single tuft hole to form the elongated bristle wall. In certain embodiments each of the plurality of arcuate cleaning elements 170*a-d* extends from a separate single tuft hole and the conical tuft 130 extends from a separate single tuft hole. Thus, each of the arcuate cleaning elements 170*a-d* extends from a different tuft hole than each of the other arcuate cleaning elements 170*a-d* and from the conical tuft 130. Each of the plurality of arcuate cleaning elements 170*a-d* includes a concave surface 171 and an opposing convex surface 172. Furthermore, in the exemplified embodiment the concave surfaces 171 of each of the plurality of arcuate cleaning elements 170*a-d* is facing or positioned adjacent to the conical tuft 130 and the convex surface 172 of each of the plurality of arcuate cleaning elements 170*a-d* is facing away from or is non-adjacent to the conical tuft 130. In some embodiments the radius of curvature of the concave surfaces 171 of the plurality of arcuate cleaning elements 170*a-d* is the same as that of the conical tuft 130.

Referring briefly to FIGS. 4 and 6, the outer surface 136 of the conical tuft 130 forms a first acute angle $\Theta_1$ with the front surface 111 of the head 110. Furthermore, the convex surface 172 of each of the plurality of arcuate cleaning elements 170*a-d* (which also forms the outer surface of the plurality of arcuate cleaning elements 170*a-d*) forms a second acute angle $\Theta_2$ with the front surface 111 of the head 110. In certain embodiments, the first acute angle $\Theta_1$ is different from the second acute angle $\Theta_2$. Furthermore, in some embodiments the second acute angle $\Theta_2$ is greater than the first acute angle $\Theta_1$. For example, in one embodiment the first acute angle $\Theta_1$ is between 80° and 85°, more specifically between 83° and 84°, and still more specifically approximately 83.5°. In one embodiment the second acute angle $\Theta_2$ is between 85° and 89°, more specifically between 87° and 88°, and still more specifically approximately 87.5°.

The conical tuft 130 is spaced apart from each of the plurality of arcuate cleaning elements 170*a-d* by a gap. Furthermore, because in the exemplified embodiment the second angle $\Theta_2$ is greater than the first angle $\Theta_1$, the gap between the outer surface 136 of the conical tuft 130 and the inner or concave surfaces 171 of each of the plurality of arcuate cleaning elements 170*a-d* decreases with distance from the front surface 111 of the head 110. Specifically, because the conical tuft 130 is oriented at a greater angle relative to the front surface 111 of the head 110 than the plurality of arcuate cleaning elements 170*a-d*, the conical tuft 130 becomes closer to each of the plurality of arcuate cleaning elements 170*a-d* the further away the conical tuft 130 and the plurality of arcuate cleaning elements 170*a-d* are from the front surface 111 of the head 110. Stated another way, the outer surface 136 of the conical tuft 130 is spaced apart from the concave surfaces 171 of each of the plurality of arcuate cleaning elements 170*a-d* by a first distance $D_1$ at the front surface 111 of the head 110. The outer surface 136 of the conical tufts 130 is spaced apart from the concave surfaces 171 of each of the plurality of arcuate cleaning elements 170*a-d* by a second distance $D_2$ at the terminal or free ends of the conical tuft 130 and of the plurality of arcuate cleaning elements 170*a-d*. Furthermore, the first distance $D_1$ is greater than the second distance $D_2$. Thus, even though both the conical tuft 130 and the plurality of arcuate cleaning elements 170*a-d* are oriented at an angle relative to the front surface 111 of the head 110, the conical tuft 130 leans outwardly away from the cavity axis C-C and towards each of the plurality of arcuate cleaning elements 170*a-d*.

As noted above, in the exemplified embodiment the ends of the bristles are melted together to form the melt matte 106 that becomes trapped between the lower surface 142 of the head plate 140 and the floor 107 of the basin 108 within which the head plate 140 is positioned. This melt matte 106 includes melted ends of all of the different bristles discussed herein. Thus, ends of each of the conical tuft 130 and the plurality of arcuate cleaning elements 170*a-d* are melted together to form a portion of the melt matte 106. Furthermore, in embodiments that include the central cleaning element 150, the ends of the central cleaning element 150 are also melted together to form a portion of the melt matte 106. Of course, all of the other cleaning elements including those described below may be melted to form a portion of the melt matte 106 as has been described herein.

In addition to the conical tuft 130, the central cleaning element 150, and the plurality of arcuate cleaning elements 170*a-d*, the tooth cleaning elements 115 also comprise many other additional cleaning elements on the head 110. Specifically, the tooth cleaning elements 115 include an outer loop of cleaning elements that includes the second and fourth arcuate cleaning elements 170*b*, 170*d* and an inner row of cleaning elements that includes the first and third arcuate cleaning elements 170*a*, 170*c*, the conical tuft 130 and the central cleaning element 150.

The outer loop of cleaning elements comprises a grouping of cleaning elements that are arranged so that the outer loop is symmetric about a longitudinal axis B-B of the head 110 and about a transverse axis that intersects the cavity axis C-C, the center point CP and is perpendicular to the longitudinal axis B-B. In the exemplified embodiment, the entirety of the tooth cleaning elements are arranged so as to be symmetric about the longitudinal axis B-B and the transverse axis. Specifically, the outer loop of cleaning elements includes proximal cleaning elements 160 located at a proximal region of the head 110 and distal cleaning elements 161 located at a distal region of the head 110. Each of the proximal cleaning elements 160 is an arcuate cleaning element located on opposing sides of the longitudinal axis B-B. Similarly, each of the distal cleaning elements 161 is an arcuate cleaning element located on opposing sides of the longitudinal axis B-B.

Starting from the proximal cleaning element 160 and working upwardly towards the distal cleaning elements 161, the left side of the head 110 (when viewed from the front as depicted in FIG. 2) has a first bristle wall 162, a first bristle tuft 163, the second arcuate cleaning element 170*b*, a second bristle tuft 164, and a second bristle wall 165. Starting from the proximal cleaning element 160 and working upwardly towards the distal cleaning elements 161, the right side of the head 110 has a third bristle wall 166, a third bristle tuft 167, the fourth arcuate cleaning element 170*d*, a fourth bristle tuft 168, and a fourth bristle wall 169. Each of these bristle tufts and bristle walls is in its own tuft hole and is spaced apart from adjacent ones of the bristle tufts and bristle walls. The first bristle wall 162 is longitudinally aligned with the third bristle wall 166 on opposing lateral sides of the head 110, the second bristle wall 165 is longitudinally aligned with the fourth bristle wall 169 on opposing lateral sides of the head, the first bristle tuft 163 is longitudinally aligned with the third bristle tuft 167 on opposing lateral sides of the head, and the second bristle tuft 164 is longitudinally aligned with the fourth bristle tuft 168 on opposing lateral sides of the head.

Furthermore, the first bristle tuft 163 is at least partially located within the space between the first arcuate cleaning element 170*a* and the second arcuate cleaning element 170*b*, the second bristle tuft 164 is at least partially located within the space between the second arcuate cleaning element 170*b* and the third arcuate cleaning element 170*c*, the third bristle tuft 167 is at least partially located within the space between the first arcuate cleaning element 170 and the fourth arcuate cleaning element 170*d*, and the fourth bristle tuft 168 is at least partially located within the space between the third arcuate cleaning element 170*c* and the fourth arcuate cleaning element 170*d*. In the exemplified embodiment the first, second, third, and fourth bristle tufts 163, 164, 167, 168 are located outside of the loop L, but they are still adjacent to and positioned in between the plurality of arcuate cleaning elements 170*a-d* as noted herein above.

Similarly, working upwardly from the proximal cleaning elements 160 to the distal cleaning elements 161, the inner row of cleaning elements comprise a fifth bristle wall 180, a fifth bristle tuft 181, the first arcuate cleaning element 170*a*, the conical tuft 130 and the central cleaning element 150, the third arcuate cleaning element 170*c*, a sixth bristle tuft 182, and a sixth bristle wall 183. Any of the bristle tufts (or the individual bristles that form the bristle tufts) can be tapered, non-tapered, rounded, spiral, or the like. Furthermore, the fifth and sixth bristle walls 180, 183 are arcuate and have a smaller radius of curvature than the plurality of arcuate cleaning elements 170*a-d*. The concave surfaces of the fifth and sixth bristle walls 180, 183 are facing each other and the conical tuft 130. The proximal and distal cleaning elements 160, 161 are also arcuate in the exemplified embodiment. The first, second, third, and fourth bristle walls 162, 165, 167, 169 are not arcuate in the exemplified embodiment, but are simply elongated bristle walls, although they could be arcuate in other embodiments.

Figure 8:
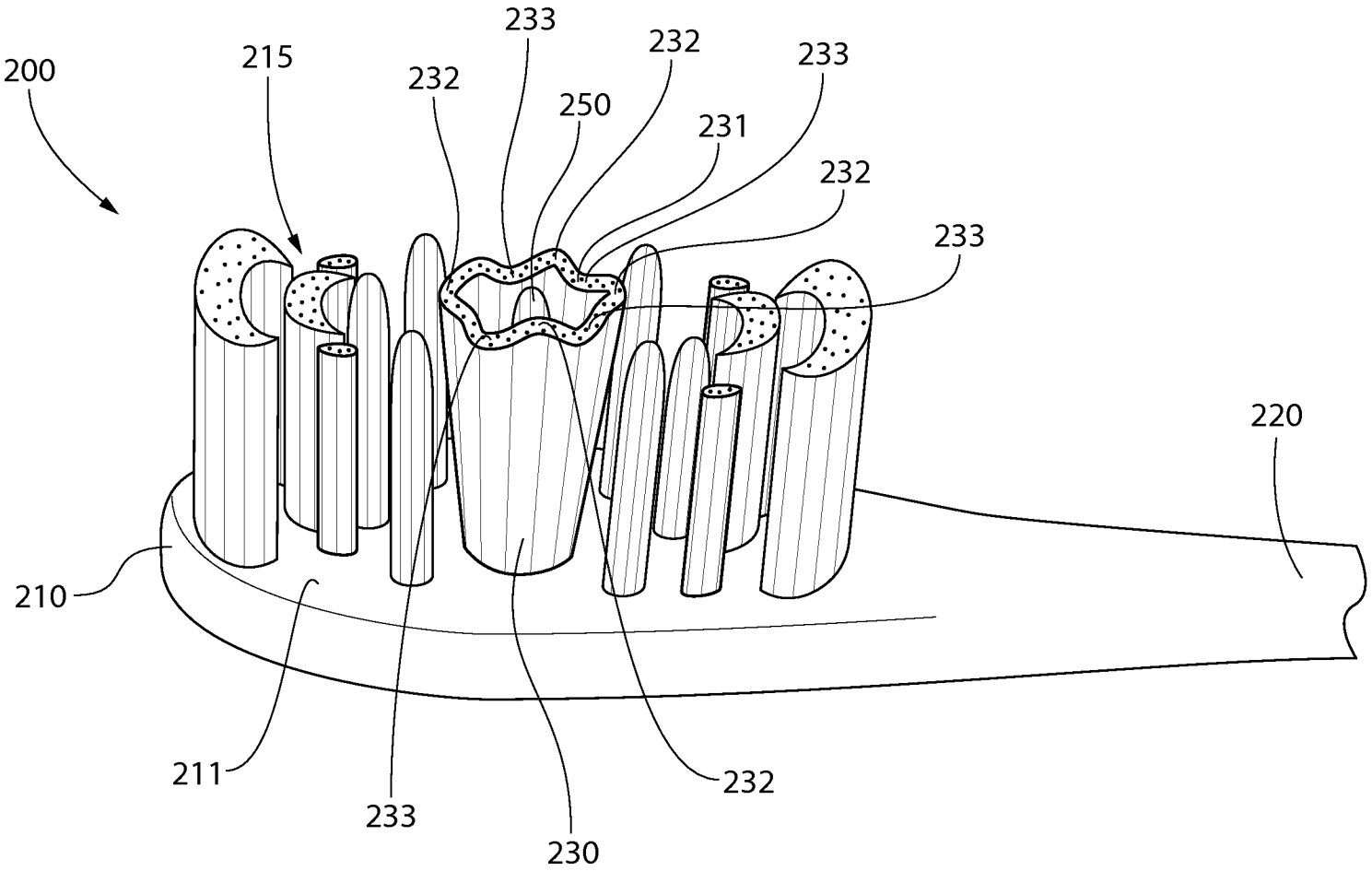
FIG. 8 is a front perspective view of an oral care implement in accordance with another embodiment of the present invention.

Referring now to FIG. 8, an oral care implement 200 will be described in accordance with another embodiment of the present invention. The oral care implement 200 is similar to the oral care implement 100 and thus much of the description above with regard to the oral care implement 100 is applicable to the oral care implement 200, except where the description of the oral care implement 100 above is contradictory to a specific description of the oral care implement 200 provided below. Features of the oral care implement 200 that are similar to features of the oral care implement 100 described above will be similarly numbered except that the 200-series of numbers will be used. Certain features of the oral care implement 200 may be labeled but not described, in which case the description of the similar feature from the oral care implement 100 applies. Furthermore, certain features of the oral care implement 200 may not be labeled, it being understood that the description of the similar feature from the oral care implement 100 applies.

The oral care implement 200 generally comprises a handle 220 and a head 210, which have the same structures, features, materials of construction, and the like as described above with regard to the oral care implement 100. Furthermore, a plurality of tooth cleaning elements 215 are positioned on and extend from a front surface 211 of the head 210. The plurality of tooth cleaning elements 215 include a conical tuft 230, a central cleaning element 250, and many additional cleaning elements that will not be described in detail herein. Specifically, although a specific configuration and pattern of the additional cleaning elements is provided in the drawings, the invention is not to be so limited. In certain embodiments, the conical tuft 230 can be used with any arrangement of additional cleaning elements, including the arrangement depicted in FIGS. 1-7. Thus, in certain embodiments the invention may be the arrangement of cleaning elements achieved by swapping out the conical tuft 130 and replacing it with the conical tuft 230. Thus, the only component of FIG. 8 that will be discussed in detail herein is the conical tuft 230, it being understood that the description of the other features above may be used with the conical tuft 230.

The conical tuft 230 is in the shape of an inverted truncated cone much like the conical tuft 130 described above. The conical tuft 230 has a first end that is inserted within a tuft hole in the head 210 (or in a head plate as discussed above), and the conical tuft 230 extends from the front surface 211 of the head 210 and terminates in an annular top surface 231. In this embodiment, the annular top surface 231 of the conical tuft 230 is an undulating or wavy surface. Thus, the side profile of the annular top surface 231 conical tuft 230 is wavy. Despite this undulating surface, the conical tuft 230 is still conical such that it has a circular or spherical transverse cross-sectional shape. Furthermore, in this embodiment the annular top surface 231 of the conical tuft 230 comprises sinusoidal-shaped undulations. Specifically, the annular top surface 231 of the conical tuft 230 undulates in height relative to the front surface 211 of the head 210. In that regard, the annular top surface 231 of the conical tuft 230 comprises a plurality of peaks 232 and a plurality of valleys 233. The plurality of peaks 232 are located at a first distance from the front surface 211 of the head 210 and the plurality of valleys 233 are located at a second distance from the front surface 211 of the head 210, the first distance being greater than the second distance. The conical tuft 230 can have any number of peaks and valleys as desired.

In this embodiment, the conical tuft 230 has a continuous bristle wall that extends 360° about an axis as discussed above with the conical tuft 130. Furthermore, the outer surface of the conical tuft 230 has a continuous cone-like shape. The undulations are formed by having some of the bristles in the conical tuft 230 having a greater height than others of the bristles in the conical tuft 230. By varying the height of the bristles within the conical tuft 230, the various peaks 232 and valleys 233 noted herein above can be formed. The conical tuft 230 can be positioned at orientations other than that depicted in FIG. 8 by rotating the conical tuft 230 relative to the head 210 so that the location of the peaks 232 and valleys 233 can be other than that which is depicted in FIG. 8.

Figure 9:
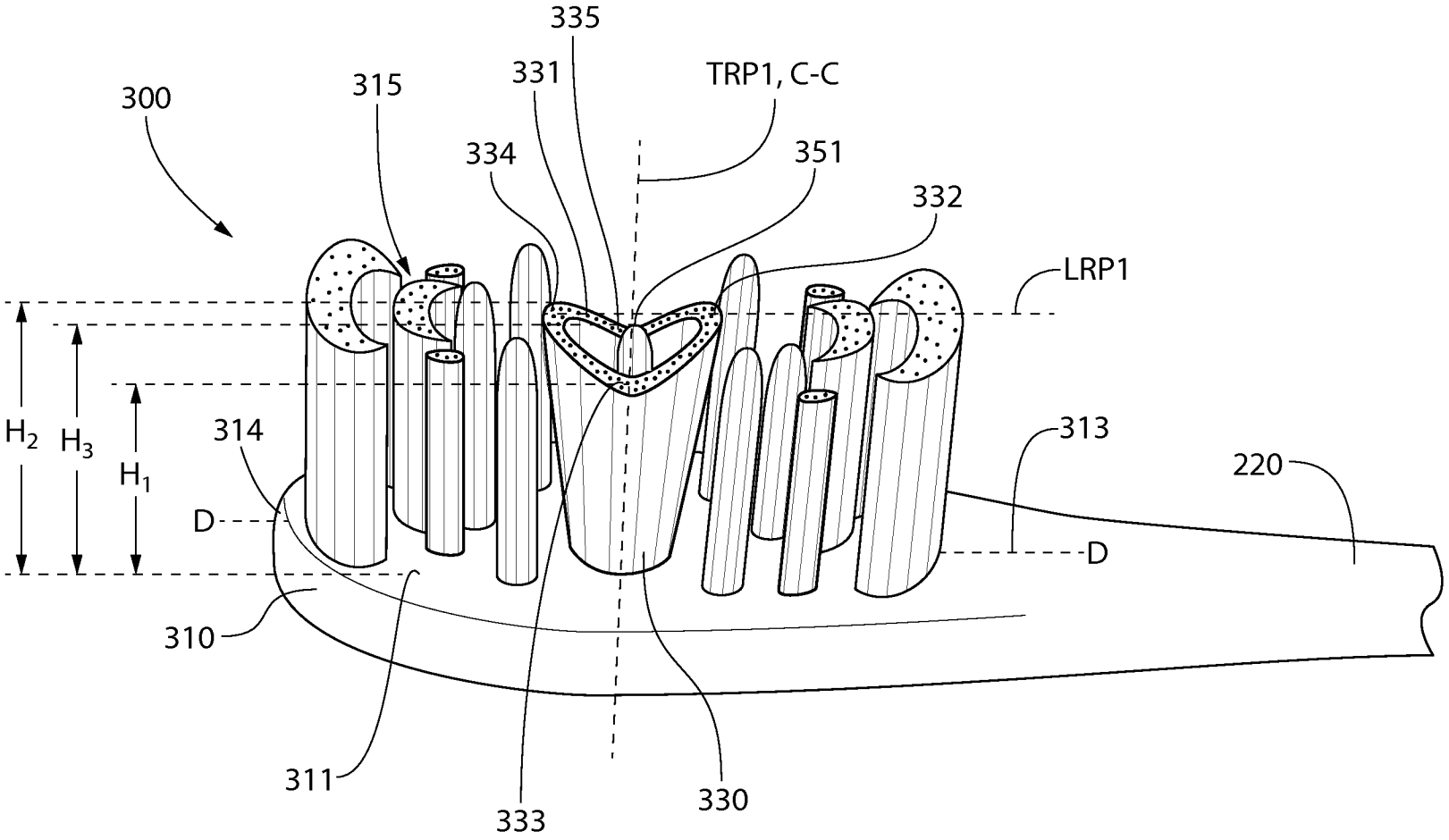
FIG. 9 is a front perspective view of an oral care implement in accordance with still another embodiment of the present invention.

Referring now to FIG. 9, an oral care implement 300 will be described in accordance with yet another embodiment of the present invention. The oral care implement 300 is similar to the oral care implement 100 and thus much of the description above with regard to the oral care implement 100 is applicable to the oral care implement 300, except where the description of the oral care implement 100 above is contradictory to a specific description of the oral care implement 300 provided below. Features of the oral care implement 300 that are similar to features of the oral care implement 100 described above will be similarly numbered except that the 300-series of numbers will be used. Certain features of the oral care implement 300 may be labeled but not described, in which case the description of the similar feature from the oral care implement 100 or from the oral care implement 200 applies. Furthermore, certain features of the oral care implement 300 may not be labeled, it being understood that the description of the similar feature from the oral care implement 100 applies.

The oral care implement 300 generally comprises a handle 320 and a head 310, which have the same structures, features, materials of construction, and the like as described above with regard to the oral care implement 100. Furthermore, a plurality of tooth cleaning elements 315 are positioned on and extend from a front surface 311 of the head 310. The plurality of tooth cleaning elements 315 include a conical tuft 330, a central cleaning element 350, and many additional cleaning elements that will not be described in detail herein. Specifically, although a specific configuration and pattern of the additional cleaning elements is provided in the drawings, the invention is not to be so limited. In certain embodiments, the conical tuft 330 can be used with any arrangement of cleaning elements, including the arrangement depicted in FIGS. 1-7. Thus, in certain embodiments the invention may be the arrangement of cleaning elements achieved by replacing the conical tuft 130 with the conical tuft 330. Thus, the only components of FIG. 9 that will be discussed in detail herein is the conical tuft 330 and the central cleaning element 350, it being understood that the description of the other features above may be used with this conical tuft 330.

In this embodiment, the head 310 of the oral care implement extends from a proximal end 313 to a distal end 314 along a longitudinal axis D-D. The conical tuft 330 is positioned on the front surface 311 of the head 310 in a similar manner, location, and orientation as the conical tuft 130 discussed above. The conical tuft 330 terminates in an annular top surface 331 that undulates in height relative to the front surface 311 of the head. Specifically, the annular top surface 311 of the conical tuft 330 comprises a first peak portion 332, a second peak portion 334, a first valley portion 333, and a second valley portion 335. The first and second peak portions 332, 334 extend a greater height from the front surface 311 of the head 310 than the first and second valley portions 333, 335. Furthermore, although in the exemplified embodiment the first and second peak portions 332, 334 extend the same height from the front surface 311 of the head 310 and the first and second valley portions 333, 335 extend the same height from the front surface 311 of the head 310, the invention is not to be so limited in all embodiments and each peak portion and each valley portion may extend different heights from the front surface 311 of the head 310 in other embodiments. Differently from the conical tuft 230, the annular top surface 331 of the conical tuft 330 comprises V-shaped undulations, although they can be sinusoidal shaped or otherwise shaped as desired in other embodiments.

In this embodiment, a longitudinal reference plane LRP1 that is substantially parallel to the longitudinal axis D-D and perpendicular to the front surface 311 of the head 310 intersects the first and second peak portions 332, 334 of the annular top surface 331 of the conical tuft 330. Furthermore, a transverse reference plane TRP1 that is substantially perpendicular to the longitudinal axis D-D and to the front surface 311 of the head 310 intersects both of the first and second valley portions 333, 335 of the annular top surface 331 of the conical tuft 330. Furthermore, in the exemplified embodiment of FIG. 9 the longitudinal reference plane LRP1 and the transverse reference plane TRP1 intersect along the cavity axis C-C. Thus, the first and second peak portions 332, 334 of the annular top surface 331 of the conical tuft 310 are longitudinally aligned along the longitudinal reference plane LRP1 and the first and second valley portions 333, 335 of the annular top surface 331 of the conical tuft 310 are transversely aligned along the transverse reference plane TRP1. Thus, due to the locations of the peak and valley portions 332, 333, 334, 335, when viewed from the transverse reference plane TRP1 the annular top surface 331 of the conical tuft 330 has a convex side profile and when viewed from the longitudinal reference plane LRP1 the annular top surface 331 of the conical tuft 330 has a V-shaped or concave side profile.

As noted above, the plurality of tooth cleaning elements 315 include the conical tuft 330 and the central cleaning element 350. The central cleaning element 350 is located within the cavity that is defined by the inner surface of the conical tuft 330 in the same manner as discussed above with regard to the oral care implement 100 and FIGS. 1-7. In the exemplified embodiment, the valley portions 333, 335 of the annular top surface 331 extend a first height H1 above the front surface 311 of the head 310, the peak portions 332, 334 of the annular top surface 331 extend a second height H2 above the front surface 311 of the head 310, and the central cleaning element 350 terminates in a free end 351 that is located at a third height H3 above the front surface 311 of the head 310. In certain embodiments the first height H1 is less than the second height H2. Furthermore, in the exemplified embodiment the third height H3 is less than the second height H2 and the third height H3 is greater than the first height H1. Of course, in other embodiments the third height H3 may be equal to or less than the second height H2 and greater than the first height H1. In still other embodiments, the third height H3 may be equal to or less than the first height H1.

Figure 10:
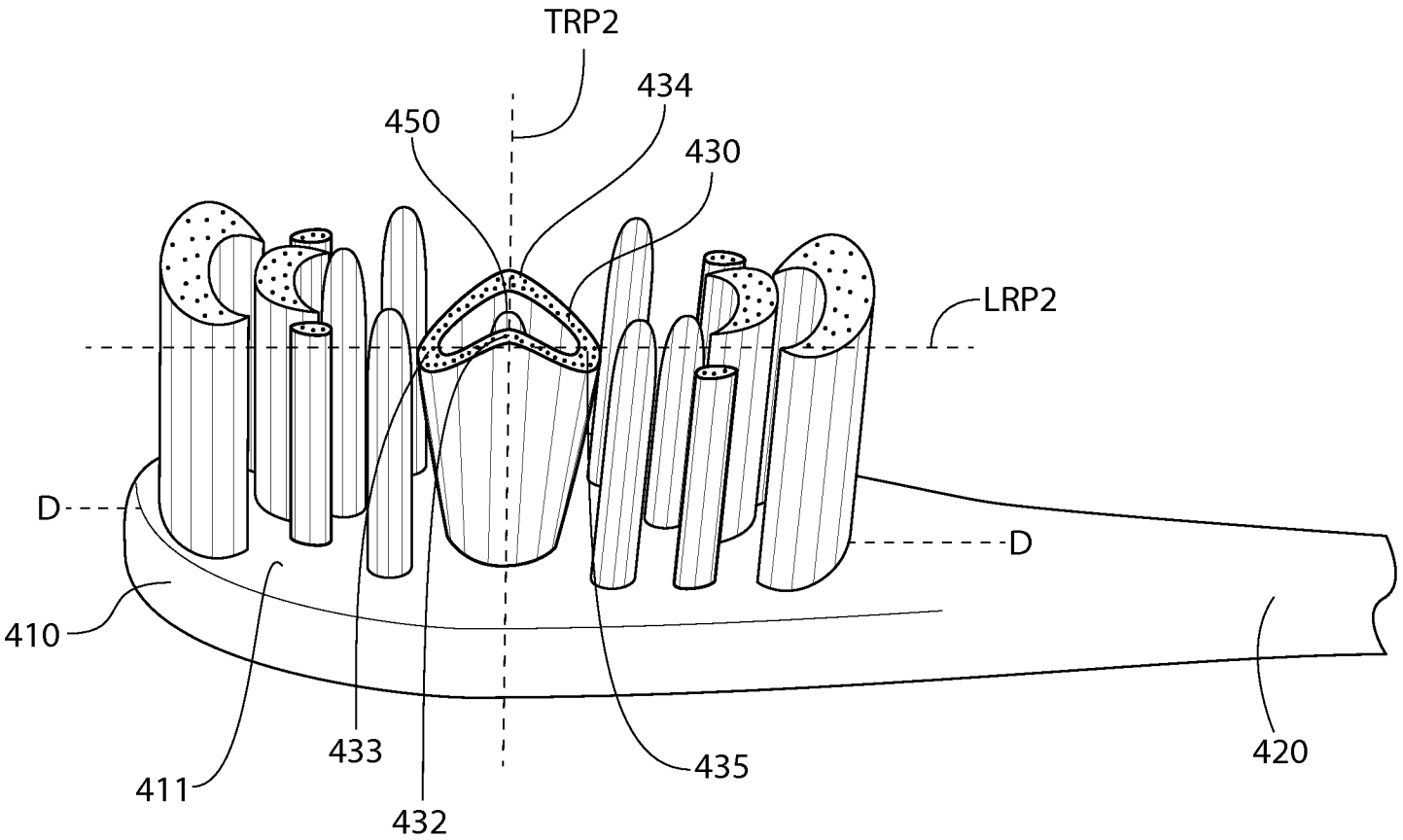
FIG. 10 is a front perspective view of an oral care implement in accordance with another embodiment.

Referring now to FIG. 10, an oral care implement 400 will be described in accordance with yet another embodiment of the present invention. The oral care implement 400 is similar to the oral care implement 300 and to the oral care implement 100, and thus much of the description above with regard to the oral care implement 100 and the oral care implement 300 is applicable to the oral care implement 400, except where the description of the oral care implements 100, 300 above is contradictory to a specific description of the oral care implement 400 provided below. Features of the oral care implement 400 that are similar to features of the oral care implements 100, 300 described above will be similarly numbered except that the 400-series of numbers will be used. Certain features of the oral care implement 400 may be labeled but not described, in which case the description of the similar feature from the oral care implement 100, 300 applies. Furthermore, certain features of the oral care implement 400 may not be labeled, it being understood that the description of the similar feature from the oral care implement 100, 300 applies.

The oral care implement 400 is identical to the oral care implement 300 except that the conical tuft 430 has been rotated ninety degrees relative to the head 410. Thus, in the oral care implement 300 the peaks 332, 334 were aligned along the longitudinal axis D-D of the head 310, but in the oral acre implement 430 the valley portions 433, 435 are aligned along the longitudinal axis D-D of the head 410. Thus, in this embodiment, a longitudinal reference plane LRP2 that is substantially parallel to the longitudinal axis D-D and perpendicular to the front surface 411 of the head 410 intersects the first and second valley portions 433, 435 of the annular top surface 431 of the conical tuft 430 and a transverse reference plane TRP2 that is substantially perpendicular to the longitudinal axis D-D and perpendicular to the front surface 411 of the head 410 intersects the first and second peak portions 432, 434 of the annular top surface 431 of the conical tuft 430. In this embodiment, the annular top surface 431 has a concave (or V-shaped) side profile when viewed from the transverse reference plane TRP2 and a convex side profile when viewed from the longitudinal reference plane LRP2.

In either of the embodiments of FIGS. 9 and 10, the central tooth cleaning element 350, 450 may be shorter than the valley portions of the conical tufts 330, 430, the same height as the valley portions of the conical tufts 330, 430, taller than the valley portions of the conical tufts 330, 430 but shorter than the peak portions of the conical tufts 330, 430, the same height as the peak portions of the conical tufts 330, 430, or taller than the peak portions of the conical tufts 330, 430 as desired to achieve a particular cleaning result. Furthermore, as discussed previously the central tooth cleaning elements 350, 450 may also be omitted in some embodiments.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle;

a head coupled to the handle, the head comprising a front surface;

a plurality of tooth cleaning elements extending from the front surface of the head;

the plurality of tooth cleaning elements comprising:

a conical tuft comprising a continuous bristle wall having an inner surface defining a cavity along a cavity axis, the cavity having a transverse cross-sectional area that increases with distance from the front surface of the head; and a central cleaning element located within the cavity;

wherein the continuous bristle wall of the conical tuft terminates in an annular top surface that undulates in height relative to the front surface, the head extending from a proximal end to a distal end along a longitudinal axis, and wherein the annular top surface comprises a plurality of peak portions and a plurality of valley portions located on each side of the longitudinal axis.

2. The oral care implement according to claim 1 wherein the central cleaning element converges with the continuous bristle wall at a position located below the front surface of the head such that an annular gap formed between the central cleaning element and the inner surface of the continuous bristle wall extends below the front surface of the head.

3. The oral care implement according to claim 2 wherein the conical tuft and central cleaning element are secured to the head by anchor free tufting.

4. The oral care implement according to claim 3 wherein the central cleaning element is a bristle tuft, and wherein the conical tuft and the central cleaning element converge in a bristle matte that is formed by ends of bristles of the conical tuft and the central cleaning element that are melted together.

5. The oral care implement according to claim 1 wherein the conical tuft comprises a plurality of bristles inclined away from the cavity axis.

6. The oral care implement according to claim 1 wherein wherein a longitudinal reference plane that is substantially parallel to the longitudinal axis and perpendicular to the front surface of the head intersects first and second ones of the plurality of valley portions; and wherein a transverse reference plane that is substantially perpendicular to the longitudinal axis and perpendicular to the front surface of the head intersects first and second peak portions.

7. The oral care implement according to claim 6 wherein the longitudinal reference plane and the transverse reference plane intersect along the cavity axis.

8. The oral care implement according to claim 1 wherein the central cleaning element has a free end located at a height which is less than a maximum height of the plurality of peak portions and greater than a minimum height of the plurality of valley portions.

9. The oral care implement according to claim 1 wherein wherein a longitudinal reference plane that is substantially parallel to the longitudinal axis and perpendicular to the front surface of the head intersects first and second ones of the plurality of peak portions; and wherein a transverse reference plane that is substantially perpendicular to the longitudinal axis and perpendicular to the front surface of the head intersects first and second ones of the plurality of valley portions.

10. The oral care implement according to claim 1 wherein a first valley portion has a first height above the front surface of the head and a first peak portion has a second height above the front surface of the head; wherein the first height is less than the second height; and wherein the central cleaning element terminates in a free end at a third height above the front surface of the head, the third height being less than or equal to the second height and greater than the first height.

11. The oral care implement of claim 1 wherein the conical tuft and the central cleaning element extend from a single tuft hole.

12. An oral care implement comprising:

a handle;

a head coupled to the handle, the head comprising a front surface;

a plurality of tooth cleaning elements extending from the front surface of the head;

the plurality of tooth cleaning elements comprising a conical tuft comprising a bristle wall having an inner surface defining a cavity along a cavity axis, the cavity having a transverse cross-sectional area that increases with distance from the front surface of the head; and wherein the bristle wall of the conical tuft terminates in an annular top surface that undulates in height relative to the front surface;

wherein the bristle wall of the conical tuft terminates in an annular top surface that undulates in height relative to the front surface, the head extending from a proximal end to a distal end along a longitudinal axis, and wherein the annular top surface comprises a plurality of peak portions and a plurality of valley portions located on each side of the longitudinal axis.

13. The oral care implement according to claim 12 wherein the conical tuft is secured to the head by anchor free tufting.

14. The oral care implement according to claim 12 wherein a longitudinal reference plane that is substantially parallel to the longitudinal axis and perpendicular to the front surface of the head intersects first and second ones of the plurality of valley portions; and wherein a transverse reference plane that is substantially perpendicular to the longitudinal axis and perpendicular to the front surface of the head intersects first and second ones of the plurality of peak portions.

15. The oral care implement according to claim 12 wherein a longitudinal reference plane that is substantially parallel to the longitudinal axis and perpendicular to the front surface of the head intersects first and second ones of the plurality of peak portions; and wherein a transverse reference plane that is substantially perpendicular to the longitudinal axis and perpendicular to the front surface of the head intersects first and second ones of the plurality of valley portions.

16. The oral care implement according to claim 12 wherein the bristle wall of the conical tuft is continuous.

17. An oral care implement comprising:

a handle;

a head coupled to the handle, the head comprising a front surface;

a plurality of tooth cleaning elements extending from the front surface of the head;

the plurality of tooth cleaning elements comprising a conical tuft comprising a bristle wall having an inner surface defining a cavity along a cavity axis, the cavity having a transverse cross-sectional area that increases with distance from the front surface of the head; and the plurality of tooth cleaning elements comprising a plurality of arcuate cleaning elements arranged in a spaced apart manner about a loop that surrounds the conical tuft;

wherein the plurality of arcuate cleaning elements comprises a first, second, third, and fourth arcuate cleaning element, the first and third arcuate cleaning elements intersecting a longitudinal axis of the head;

wherein the bristle wall of the conical tuft terminates in an annular top surface that undulates in height relative to the front surface, the head extending from a proximal end to a distal end along a longitudinal axis, and wherein the annular top surface comprises a plurality of peak portions and a plurality of valley portions located on each side of the longitudinal axis.

18. The oral care implement of claim 17 wherein the second and fourth arcuate cleaning elements do not intersect the longitudinal axis of the head.

19. The oral care implement of claim 17 wherein the loop of the plurality of arcuate cleaning elements are equally spaced about the conical tuft.

* * * * *